US011872472B2

(12) United States Patent
Ruzicka

(10) Patent No.: US 11,872,472 B2
(45) Date of Patent: Jan. 16, 2024

(54) SPLIT SNOWBOARD

(71) Applicant: Donald Ruzicka, Jackson Hole, WY (US)

(72) Inventor: Donald Ruzicka, Jackson Hole, WY (US)

( * ) Notice: Subject to any disclaimer, the term of this patent is extended or adjusted under 35 U.S.C. 154(b) by 0 days.

(21) Appl. No.: 17/903,794

(22) Filed: Sep. 6, 2022

(65) Prior Publication Data

US 2023/0076150 A1 Mar. 9, 2023

Related U.S. Application Data

(60) Provisional application No. 63/241,522, filed on Sep. 7, 2021.

(51) Int. Cl.

| | |
|---|---|
| ***A63C 5/03*** | (2006.01) |
| ***A63C 5/04*** | (2006.01) |
| ***A63C 5/048*** | (2006.01) |

(52) U.S. Cl.

CPC ..... *A63C 5/031* (2013.01); *A63C 5/0405* (2013.01); *A63C 5/0485* (2013.01); *A63C 2203/06* (2013.01)

(58) Field of Classification Search

CPC .. A63C 5/02; A63C 5/048; A63C 5/07; A63C 5/0422; A63C 5/031; A63C 5/0405; A63C 5/0485; A63C 2203/06

See application file for complete search history.

(56) References Cited

U.S. PATENT DOCUMENTS 5,551,728 A * 9/1996 Barthel ..... A63C 5/16 280/14.1
5,660,416 A * 8/1997 Schiele ..... A63C 5/16 280/809

(Continued)

FOREIGN PATENT DOCUMENTS

DE 9209879 U1 9/1992
DE 9209879 U1 * 10/1992

(Continued)

OTHER PUBLICATIONS

USPTO acting as International Searching Authority, "International Search Report and Written Opinion," for International Application No. PCT/US2022/042649, dated Dec. 13, 2022.

*Primary Examiner* — James A Shriver, II
*Assistant Examiner* — Michael T. Walsh
(74) *Attorney, Agent, or Firm* — Dentons Durham Jones Pinegar; Sarah W. Matthews

(57) ABSTRACT

A system and method for providing a ski-snowboard device capable of skinning in an uphill ski mode and skiing in a downhill snowboard mode. The system may include two skis with inner and outer edges having substantially concave side cuts, and an insert that fits into the space between the inner edge side cuts of each of the two skis. The concave side cuts of the inner edges of the skis may have a groove formed in each, and a mating tongue on each side of the insert can fit into the grooves in a downhill snowboard mode. The tongue-and-groove connection may improve the torsional stiffness of the board, and the concave side cuts may allow a user to better grip when skiing and eliminate the step of switching the skis when used as sides of the snowboard.

19 Claims, 6 Drawing Sheets

(56) References Cited

U.S. PATENT DOCUMENTS

| | | | | |
|---|---|---|---|---|
| 8,246,070 | B2 * | 8/2012 | Lin | A63C 9/007 280/618 |
| 8,708,371 | B2 * | 4/2014 | Balun | A63C 5/031 280/818 |
| 9,717,977 | B2 | 8/2017 | De Loore et al. | |
| 10,518,164 | B1 * | 12/2019 | Ritter | A63C 5/03 |
| 11,065,529 | B2 * | 7/2021 | Ortwig | A63C 5/044 |
| 2007/0164522 | A1 * | 7/2007 | Ellison | A63C 5/04 280/14.22 |
| 2013/0193672 | A1 * | 8/2013 | Bulan | A63C 5/033 280/607 |
| 2015/0157920 | A1 * | 6/2015 | Adamczewski | A63C 5/033 280/601 |
| 2017/0050105 | A1 * | 2/2017 | Browning | A63C 5/031 |
| 2018/0200606 | A1 * | 7/2018 | Ritter | A63C 5/031 |

FOREIGN PATENT DOCUMENTS

| | | | | |
|---|---|---|---|---|
| DE | 29618514 | U1 * | 1/1997 | A63C 5/02 |
| DE | 19703773 | A1 | 8/1998 | |
| EP | 635286 | A1 * | 1/1995 | A63C 5/02 |
| FR | 2579474 | A1 | 10/1986 | |
| FR | 3016301 | A1 | 7/2015 | |
| GB | 2469463 | A * | 10/2010 | B63B 35/7916 |
| WO | 1998017355 | A1 | 4/1998 | |
| WO | 2011099155 | A1 | 8/2011 | |

* cited by examiner

SPLIT SNOWBOARD

PRIORITY CLAIM

This application claims priority under 35 U.S.C. 119 to U.S. provisional application No. 63/241,522, filed Sep. 7, 2021, and the entire contents of the 63/241,522 application is hereby incorporated herein in its entirety.

TECHNICAL FIELD

The present disclosure relates generally to a snow-sport device that includes a split snowboard that can be split to use as skis, or put together to use as a snowboard, i.e., snowboards which may be divided, or snow-ski boards with two or more runners or skis that can be connected together by a rider-supporting platform. More particularly, the present invention pertains to devices and methods that allow a snowboard to be converted into skis with particular features to enable the skis to be used in skiing uphill, commonly known as skinning or splitboarding.

BACKGROUND

Skiing and snowboarding have long been popular snow sports. More recently, uphill skiing has grown in popularity. Uphill skiing provides a good workout, avoids lines and crowds on ski lifts, and often does not require purchasing an expensive lift ticket. When done on with traditional skis, users attach synthetic, snow-gripping skins to the bottom of their skis to ski uphill. When done with a snowboard, users often use a device known as a splitboard and skinning may be referred to as "splitboarding."

A splitboard is a reconfigurable snowboard/alpine-trekking ski combination designed with various clasps and multi-purpose binding configurations to allow a user to physically split a snowboard down its length into two skis, reconfigure the bindings, and use the skis for cross country skiing, trekking, or skinning uphill.

Like downhill skis, snowboards are typically designed with substantially parabolic edges to facilitate turning. Because splitboards are functionally limited by their straight inner edge, users typically "reverse" the sides of the splitboard when using them as skis, so that the parabolic outer edge of the splitboard is the inside edge of the ski used for skinning.

SUMMARY OF DISCLOSURE

According to one aspect, a ski-snowboard system for downhill snowboarding and uphill skinning may include: a first ski having an outer edge with a substantially concave outer edge side cut and an inner edge with a substantially concave inner edge side cut, the inner edge side cut having a greater degree of curvature than the outer edge side cut, at least a portion of the inner edge having a cutaway therein forming a first ski inner edge groove; a second ski having an outer edge with a substantially concave outer edge side cut and an inner edge with a substantially concave inner edge side cut, the inner edge side cut having a greater degree of curvature than the outer edge side cut, at least a portion of the inner edge having a cutaway therein forming a second ski inner edge groove; an insert having a substantially convex first edge with a first tongue extending from the first edge, the first tongue to engage the first ski inner edge groove, the insert having a substantially convex second edge with a second tongue extending from the second edge, the second tongue to engage the second ski inner edge groove; the system having a first uphill configuration in which the first ski and second ski are separated, and a second downhill configuration in which at least a portion of the inner edge of the first ski is attached to at least a portion of the inner edge of the second ski to form a snowboard and the insert is fitted between the first ski and the second ski, with the first tongue of the insert engaging the first ski inner edge groove and the second tongue engaging the second ski inner edge groove to increase a torsional stiffness of the second downhill configuration.

In some configurations, the inner edge groove is formed in the inner edge side cut of the first ski and the second ski.

According to a further aspect, the system may comprise a fastening device comprising a first part and a second part, the first part mounted on the first ski and the second part mounted on the second ski, the fastening device being configured to reversibly affix the inside edge of the first ski to the inside edge of the second ski.

In some configurations, the inner edge of the first ski comprises a substantially planar first portion towards a tip of the ski, a substantially planar second portion towards a tail of the ski, and wherein the substantially concave inner edge side cut comprises a middle portion of the inner edge of the first ski. Similarly, the inner edge of the second ski may comprise a substantially planar first portion towards a tip of the ski, a substantially planar second portion towards a tail of the ski, and wherein the substantially concave inner edge side cut comprises a middle portion of the inner edge of the second ski.

In another exemplary configuration, a ski-snowboard combination system for downhill snowboarding and uphill skinning may comprise: a first ski having an outer edge and an inner edge with a substantially concave shape, at least a portion of the inner edge forming a first ski inner edge groove; a second ski having an outer edge and an inner edge with a substantially concave shape, at least a portion of the inner edge forming a second ski inner edge groove; an insert having a substantially convex first edge and a substantially convex second edge; and the system having a first uphill configuration in which the first ski and second ski are separated, and a second downhill configuration in which at least a portion of the inner edge of the first ski is attached to at least a portion of the inner edge of the second ski to form a snowboard and the insert is fitted between the first ski and the second ski.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

DETAILED DESCRIPTION

Figure 1:
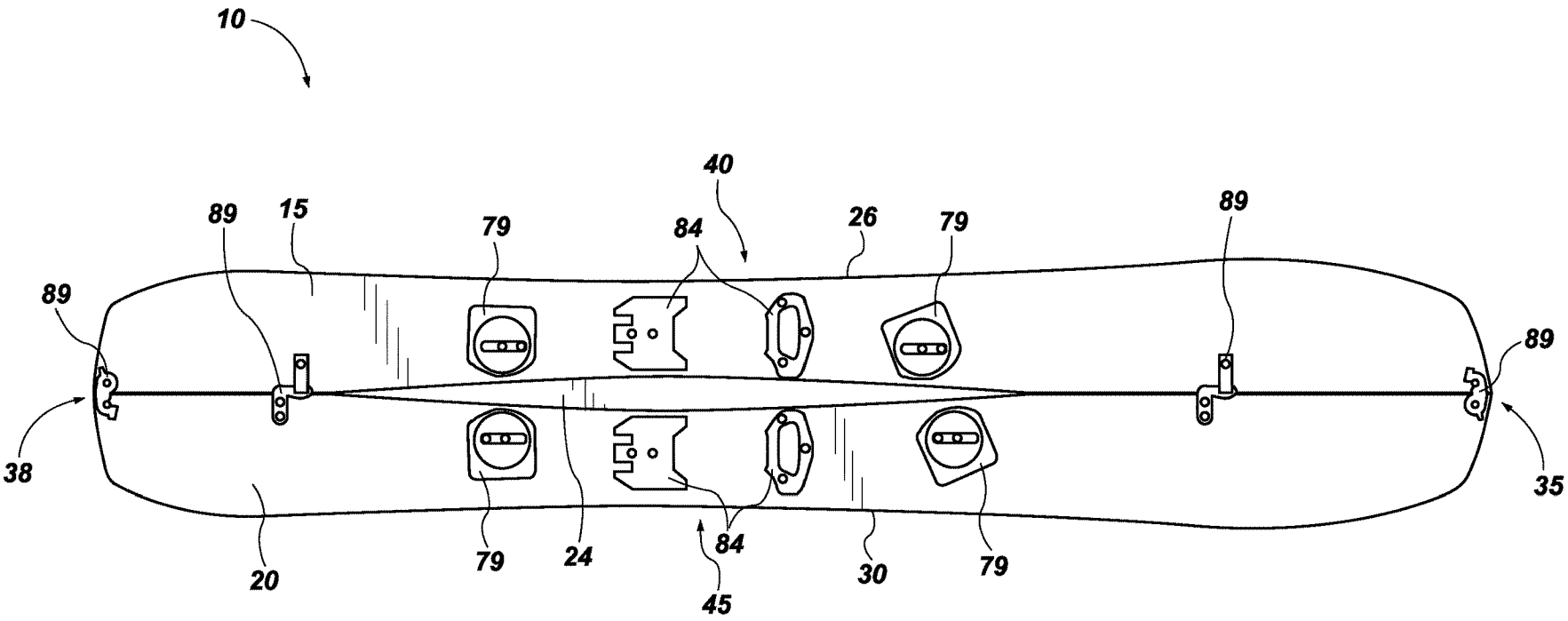
FIG. 1 illustrates a top, plan view of an embodiment of a ski-snowboard system.

The following provides a detailed description of particular embodiments of the present invention. Reference will now be made to the drawings in which the various elements of the illustrated configurations will be given numerical designations and in which the invention will be discussed so as to enable one skilled in the art to make and use the invention. It is to be understood that the following description is only exemplary of the principles of the present invention, and should not be viewed as narrowing the scope of the claims which follow, which claims define the full scope of the invention.

Certain embodiments are described herein. Of course, variations on these described embodiments will become apparent to those of ordinary skill in the art upon reading the foregoing description. The author(s) of this disclosure expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context. Such combinations are specifically contemplated as being within the scope of the present invention, regardless of whether they are explicitly described as a combination herein.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Furthermore, if any references have been made to patents and printed publications throughout this disclosure, each of these references and printed publications are individually incorporated herein by reference in their entirety.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

It will be appreciated that various aspects discussed in one drawing may be present and/or used in conjunction with the embodiment shown in another drawing, and each element shown in multiple drawings may be discussed only once. For example, in some cases, detailed description of well-known items or repeated description of substantially the same configurations may be omitted. This facilitates the understanding of those skilled in the art by avoiding an unnecessarily redundant description. The accompanying drawings and the following description are provided in order for those skilled in the art to fully understand the present disclosure, and these are not intended to limit the scope of claims. All statements herein reciting principles, aspects, and embodiments of the invention, as well as specific examples thereof, are intended to encompass equivalents thereof.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

The terms "a," "an," "the," and similar referents used in the context of describing the embodiments of the present disclosure (especially in the context of the following claims) are to be construed to cover both the singular and the plural, unless otherwise indicated herein or clearly contradicted by context. In the specification and claims, the singular forms include plural referents unless the context clearly dictates otherwise. As used herein, unless specifically indicated otherwise, the word "or" is used in the "inclusive" sense of "and/or" and not the "exclusive" sense of "either/or." Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

As used in this specification and the appended claims, singular forms such as "a," "an," and "the" may include the plural unless the context clearly dictates otherwise. Thus, for example, reference to "a binding" may include one or more of such bindings, and reference to "the ski" may include reference to one or more of such skis.

As used herein, the term "substantially" refers to the complete or nearly complete extent or degree of an action, characteristic, property, state, structure, item, or result to function as indicated. For example, a shape that is "substantially" convex shape may be either completely convex or nearly completely convex. The use of "substantially" is equally applicable when used in a negative connotation to refer to the complete or near complete lack of an action, characteristic, property, state, structure, item, or result. In one embodiment, the term "substantially" refers to numerical parameters within 10% of the indicated range. For example, an object that is "substantially" horizontal may be either completely horizontal at 90 degrees, or within 10% of the range (from 81 degrees to 99 degrees). As used herein the term "generally" refers to something that is more of the designated adjective than not, or the converse if used in the negative. The term "inside" or "inner" may refer to an edge and/or side of a ski that is more medial, or closer to a user's midline, compared to the "outside" or "outer" edge. The "outside" or "outer" edge is more lateral or away from the user's midline compared to the inside or inner edge.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 5 to about 60" should be interpreted to include not only the explicitly recited values of about 1 to about 5, but also include individual values and sub-ranges within the indicated range. Thus, included in this numerical range are individual values such as 6, 7, 8, 9, etc., through 60, and sub-ranges such as from 10-20, from 30-40, and from 50-60, etc., as well as each number individually. This same principle applies to ranges reciting only one numerical value as a minimum or a maximum. Furthermore, such an interpretation should apply regardless of the breadth of the range or the characteristics being described. Additionally, the word "connected" and "coupled" is used throughout for clarity of the description and can include either a direct connection or an indirect connection.

Unless otherwise indicated, all numbers expressing quantities in the specification and claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. In one embodiment, the terms "about" and "approximately" and refer to numerical parameters within 10% of the indicated range. In other embodiments, the term "about" is used to provide flexibility to a numerical range endpoint by providing that a given value may be "a little above" or "a little below" the endpoint while still accomplishing the function associated with the range. As used herein, a plurality of items, structural elements, compositional elements, and/or materials may be presented in a common list for convenience. However, these lists should be construed as though each member of the list is individually identified as a separate and unique member.

Figure 2:
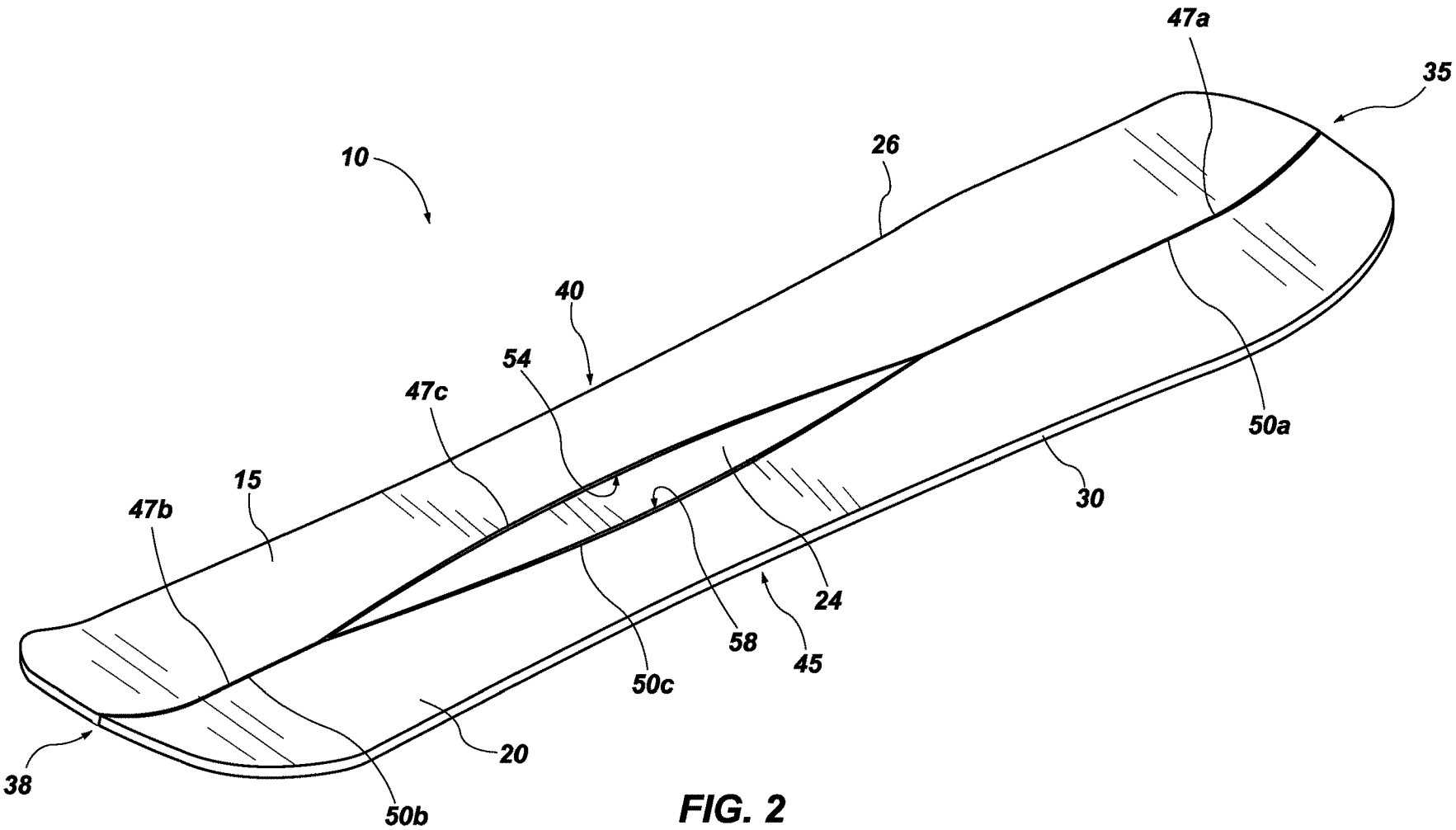
FIG. 2 provides a top, tail-end perspective view of an embodiment of a ski-snowboard system, such as that depicted in FIG. 1.
Figure 3:
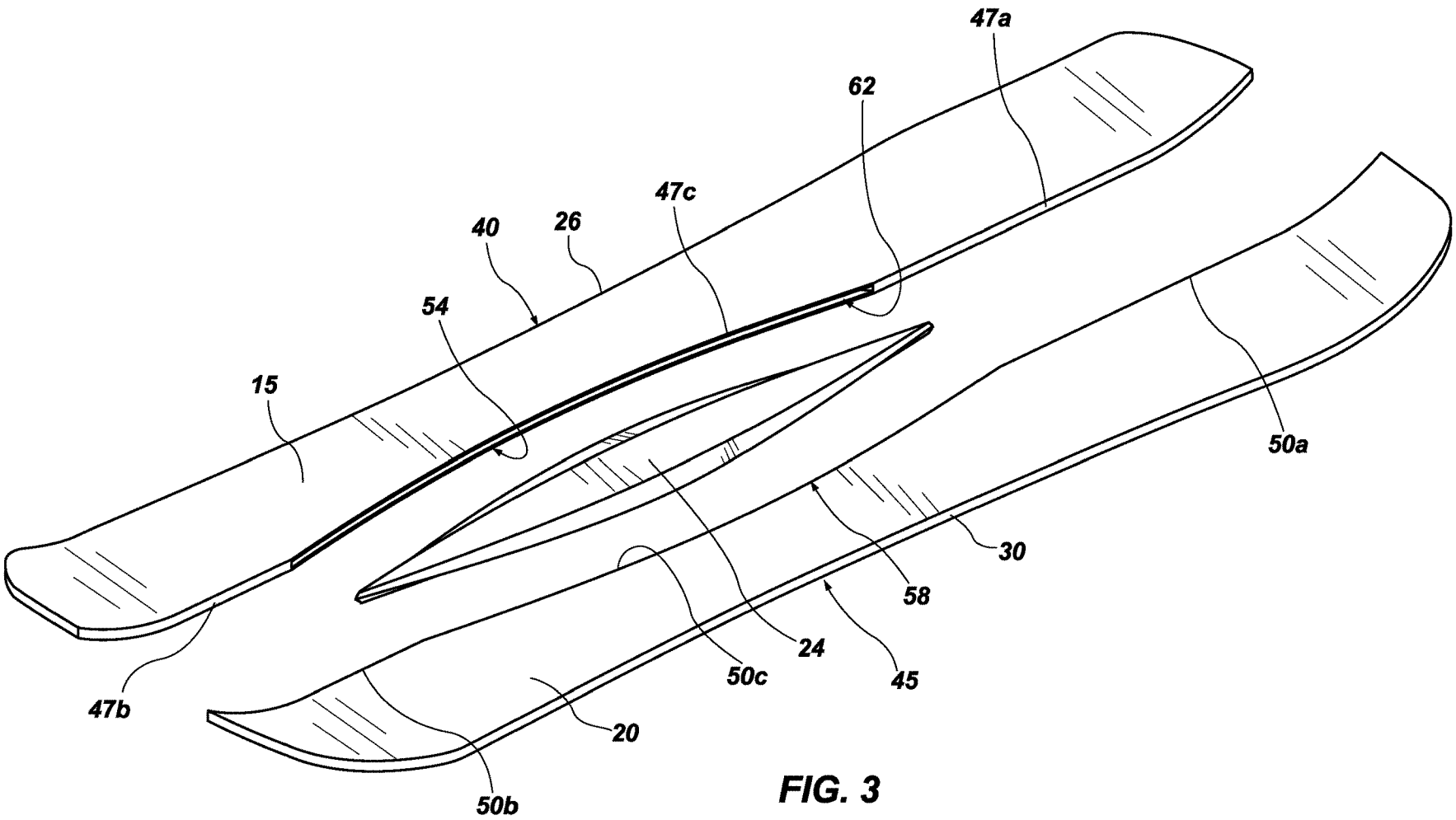
FIG. 3 provides an exploded view of the embodiment of FIG. 2 with the skis and insert separated.

The present disclosure relates generally to a system and method for a ski-snowboard combination that allows a user to snowboard downhill and skin with skis uphill. FIGS. 1-3 show an exemplary configuration of a ski-snowboard system 10. The system 10 may generally include a first ski 15, a second ski 20, and an insert 24. In the configurations shown in FIGS. 1-3, the ski-snowboard system 10 has generally concave, or curving inwardly, side cuts to form an exemplary shape of the system 10 when it is in a downhill-snowboard configuration. In other configurations, alternative side cuts, no side cuts, or other shapes may be used. The term "side cut" refers to the shape of the edge line running along the ski or snowboard, the interface between the skier and the mountain during a turn. Depending on a user's height and weight, the ski-snowboard system may have various lengths, widths, and shapes to accommodate a user and the shapes and sizes shown in FIGS. 1-3 are shown by way of example and not limitation or exclusion of other shapes and sizes.

The ski-snowboard system 10 may have a first skinning or uphill configuration in which the first ski 15 and the second ski 20 are separated (FIG. 3). In this configuration, the insert 24 may be removed and may not be needed. In some configurations, the insert 24 is shaped and sized so that it may fit in a user's backpack when skinning uphill and not needed. The ski-snowboard system 10 may have a second snowboard or downhill configuration in which the first ski 15 is attached to the second ski 20, with the insert 24 placed between the first ski 15 and the second ski 20. As explained in more detail below, each of the first ski 15 and second ski 20 may have an inner edge that is concave, or curving inwardly, and the insert 24 may be shaped to fill the void that is formed with the two skis are attached to each other.

The ski-snowboard system 10 may have a variety of shapes, sizes, and configurations as desired. Each of the first ski 15 and second ski 20 may have an outer edge (outer edge 26 on first ski 15 and outer edge 30 on second ski 20) with a substantially concave side cut. In other words, the outer edge may have a slight curve from the tip 35 to the tail 38, commonly referred to as a side cut. This outer-edge side cut (side cut 40 on first ski 15 and side cut 45 on second ski 20) may assist a user in turning when using the system as a snowboard. Snowboards often are configured with outer edges having side cuts to enable users to turn more easily as they snowboard down a hill. Side cuts may be configured with varying degrees of curvature. For example, typically the deeper the side cut or greater the degree of curvature, the easier it is for a user to turn as they snowboard down the mountain. However, as the degree of curvature increases, tracking (or how well the snowboard travels in a straight line) tends to decrease. Depending on the user, the terrain, and the desired performance of the snowboard, the outer edges may have varying degrees of curvature for the side cut. In some configurations, the outer edges may not have a side cut and/or may have a different shape such as convex, concave, straight, etc.

While first ski 15 and second ski 20 are described with outer edges 26 and 30, respectively, that have a substantially concave side cut, this is shown by way of example and the system 10 is not limited to this specific shape. The system 10 as described herein may have first and second skis 15, 20 with an outer edge (26, 30, respectively) that is concave, convex (also known as a reverse side cut), straight, or any degree of concave/convex as desired, and all shapes are contemplated herein. In some configurations, outer-edge side cuts (such as side cut 40 on first ski 15 and side cut 45 on second ski 20) may not be present. In other configurations, the side cuts may be deeper or shallower as desired.

Each of the first ski 15 and second ski 20 may further be provided with an inner edge (inner edge 47 on first ski 15 and inner edge and 50 on second ski 20, see FIG. 3). The inner edges 47 and 50, respectively, may have a front portion 47*a*, 50*a*, respectively, which is closer to the tip 35, and a rear portion 47*b*, 50*b*, respectively, which is closer to the tail 38 (portions of the inner edge 50 of second ski 20 best seen in the view shown in FIG. 5). Each of the front portion 47*a*, 50*a*, respectively, and rear portion 47*b*, 50*b*, respectively, may be a substantially planar or straight edge. This allows each of the front portions 47*a*, 50*a*, and rear portions 47*b* and 50*b*, of the first ski 15 and second ski 20 to abut one another when the system is used in the snowboard or downhill configuration.

Each of the first ski 15 and second ski 20 may further be provided with an inner edge having a middle portion 47*c* and 50*c*, respectively. The middle portion 47*c*, 50*c* of the inner edge may be between the front portion and the rear portion of the inner edge. In some configurations, the middle portion 47*c*, 50*c* may be provided with a side cut (inner edge side cut 54 on first ski 15 and inner edge side cut 58 on second ski 20) formed therein. The side cut 54 in the first ski 15 may mirror the side cut 58 in the second ski 20. In other configurations, the side cuts 54 and 58 may be individually selected and different from each other. The inner edge side cuts 54, 58, respectively may be substantially concave. When the first ski 15 and second ski 20 are attached to each other in the snowboard or downhill configuration, the inner edge side cuts 54 and 58 may form a void that is shaped as an oval with pointed ends (otherwise known as a vesica piscis-shape or almond-shape). The insert 24 may be shaped to fill this void. In other embodiments, the void formed by the side cuts may form alternative shapes. Similarly, while the specific configuration shown herein by way of example is described as having a single insert 24, two or more inserts may be used to substantially fill the void created by the inner edge side cuts 54, 58.

The side cuts 54, 58, respectively on the inner edges (inner edge 47 on first ski 15 and inner edge and 50 on second ski) may have any degree of curvature desired. In some configurations, the degree of curvature of the side cuts of the inner edges of the skis may be greater than the degree of curvature of the side cut of the outer edges of the skis. In other configurations, other degrees of curvature may be used and the degree of curvature of the inner edge side cuts may be smaller than, or equal to, the degree of curvature of the outer edge side cuts.

Where the skis are separated and used in an uphill or skinning configuration, a higher degree of curvature of the inner edge of the ski may be helpful to a user skinning uphill. That is, a high degree of curvature of the inner edge of the ski may help the user grip into the snow with the inner edge when skinning uphill. This may also, if desired, eliminate the common step in splitboarding of switching the right side of the board to use as the left ski and the left side of the board to use as the right ski when skinning uphill. This also eliminates the step of switching the skis back (left ski to right side of board and right ski to left side of board) when using the snowboard configuration.

The side cuts 54, 58, respectively on the inner edges (inner edge 47 on first ski 15 and inner edge and 50 on second ski) may also have a longitudinal, elongate cut-away forming a groove or channel (62, 65 respectively) in the side cuts 54, 58 in the middle portion (47*c* of first ski 15 and 50*c* of second ski 20, respectively) of the inner edges. The grooves 62, 65, respectively, may allow for complementary tongues of the insert 24, to be inserted. Groove 62 is visible in the view shown in FIG. 3. The grooves 62, 65 may have a depth such that the groove is able to receive the tongues 70, 75 of the insert 24 as discussed in more detail below. The grooves 62, 65 may extend the entire length of the middle portion (47*c*, 50*c*, respectively) of the inner edge, or for only part of the length of the middle portion. Other configurations may not have grooves, or may have a groove only on one side.

Figure 4:
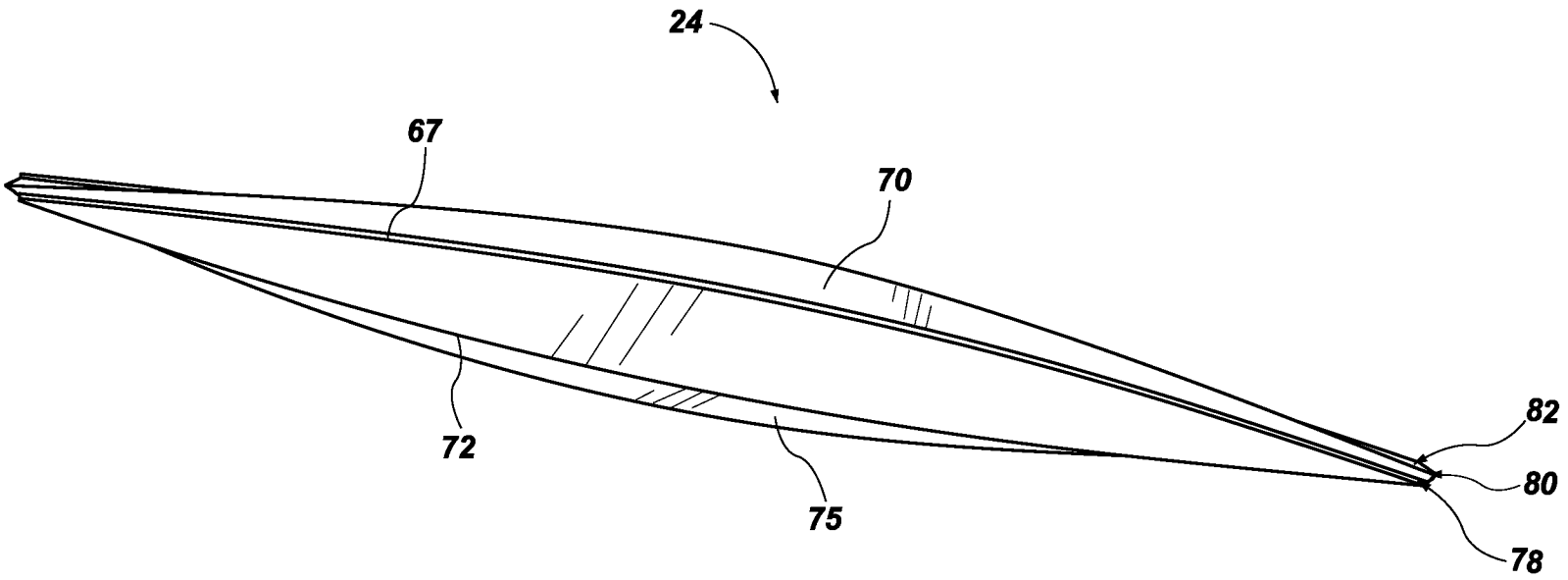
FIG. 4 provides a perspective view of an embodiment of an insert.

Turning now to FIG. 4, it can be seen that the insert 24 may have a substantially almond-shape (or oval-shaped with pointed edges), to complementary fill the void formed by the inner edge side cuts 54, 58, respectively on the inner edges (inner edge 47 on first ski 15 and inner edge and 50 on second ski). The insert 24 may have a thickness that is substantially the same thickness or a similar thickness to that of the first ski 15 and second ski 20, so that the first ski 15, second ski 20, and insert 24 form a substantially flat surface of the same thickness or substantially the same thickness when formed as a snowboard in the downhill configuration.

The insert may be formed with a top layer 78 that is made of a similar material to the first ski 15 and the second ski, a middle layer 80 that is made of a metal or metal alloy, and a bottom layer 82 that is similar to the top layer. The middle layer formed of a metal, metal alloy, or other similar torsionally stiff material may allow the insert 24 to provide additional torsional stiffness to the splitboard, particularly through the tongues or projections 70, 75, as described in more detail below. In other configurations, the entire insert 24 may be made of the same material, or other suitable types of materials and combinations of materials may be used.

Figure 6:
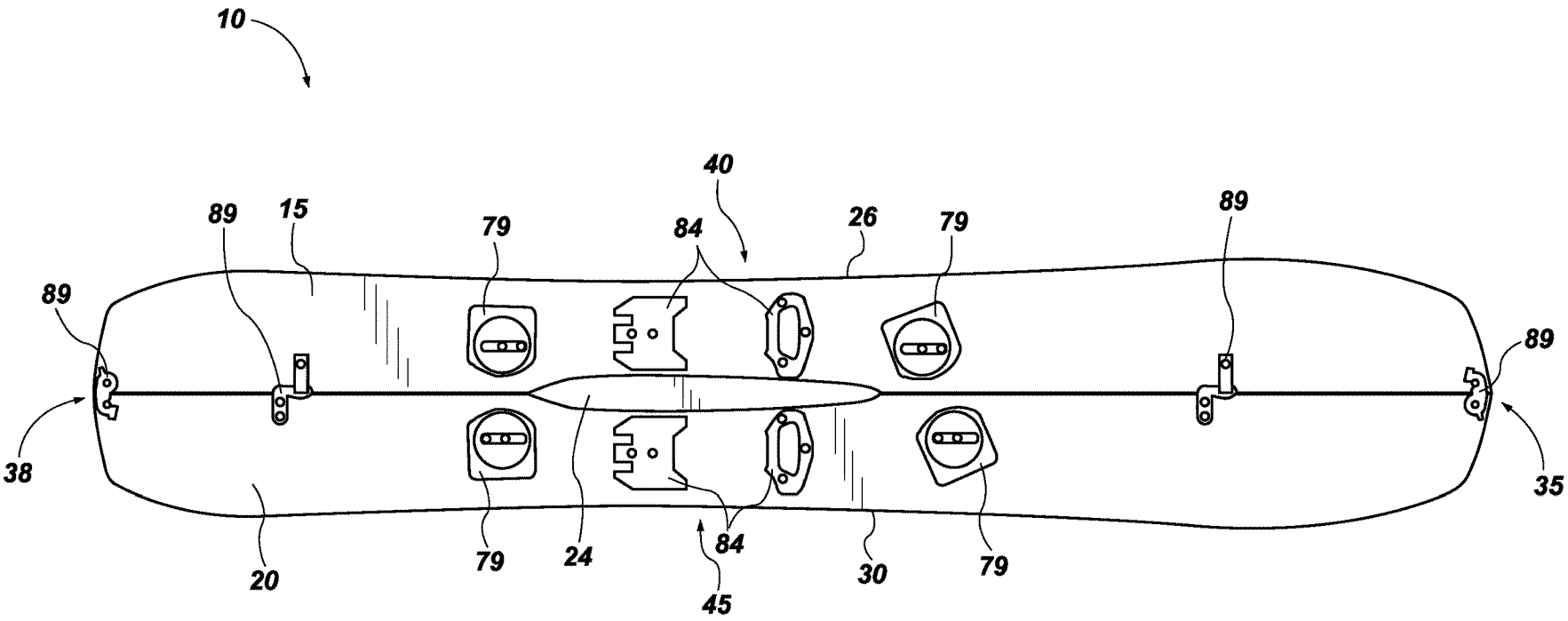
FIG. 6 illustrates a top, plan view of yet another embodiment of a ski-snowboard system.

The length of the insert 24 may depend on the length of the overall splitboard. For example, a longer splitboard for a larger user may have an insert 24 with a longer length. The length of the insert 24 may generally correlate to the distance between the user's feet in the snowboard or downhill configuration, such that the insert 24 is located between the user's feet. In other configurations, the insert may be longer or shorter as desired. Typically, as a snowboard increases in length from tip to tail, the stance width gets bigger because the rider is usually taller and thus her/his feet are farther apart. In some configurations, the length of the insert 24 may be about 20 centimeters to about 150 centimeters. More specifically, the length of the insert 24 may be about 40 centimeters to about 80 centimeters. In other configurations, the length of the insert 24 may be chosen such that it fits within a user's backpack when not in use (i.e., in the uphill-skinning configuration). FIG. 6 shows an exemplary configuration of an insert 24 that has a shorter length compared to the insert 24 shown in FIG. 1.

The width of the insert 24 may depend on the degree of curvature of the side cuts along the inner edge of the skis 15, 20. For example, the widest point of the insert 24, near the middle of the almond-shaped insert 24, may be about 2 centimeters to about 11 centimeters. More specifically, the widest point of the insert 24 may be about 6 centimeters to about 9 centimeters. In some configurations, snowboards with a longer length may have a larger degree of curvature for the side cuts and therefore a wider insert 24.

The almond-shaped insert 24 may have a substantially convex, or curving outward, first edge 67 with a first tongue 70 extending from the first edge 67, and a substantially convex second edge 72 opposite the first edge 67, with a second tongue 75 extending from the second edge 72 (FIG. 4). The tongues may be longitudinal (from tip to tail) and elongate, projecting outwards from the edges 67, 72, respectively, of the insert 24. The tongues 70, 75 may extend the entire length of the edges of the insert 24, or the tongues may extend for only part of the length of the insert 24. The tongues may be, for example, proximal to a lateral middle of the insert 24.

Figure 5:
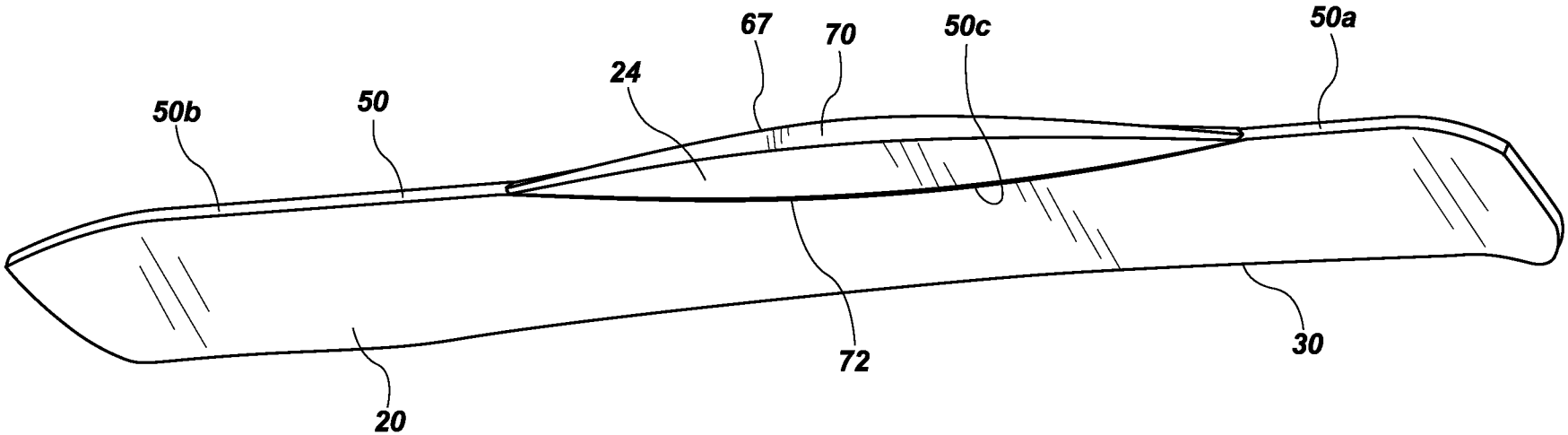
FIG. 5 provides a perspective view of an embodiment of a single ski and an insert, showing the tongue of one side of the insert in place in the groove of the ski.

The tongues 70, 75 may interface or engage with the respective grooves 62, 65 of the side cuts on the inner edges of each of the first ski 15 and second ski 20 (see FIG. 5). In some configurations, the middle layer 80 of the insert 24 may be formed of a metal layer as described above, and this metal layer may extend outwardly past the top layer and bottom layer of the insert 24, forming the tongues 70, 75. The layer of metal sandwiched in middle may provide additional integrity to the insert 24. Another benefit of metal or another strong material to form the tongues is that it allows tongues to be used to clean the opposing groove free of snow and ice when putting the board together as described below. The tongues 70, 75 may be formed of metal, of composite, polymer, or any other suitable material known in the art.

With a tongue-and-groove connection, the insert 24 may increase the torsional stiffness of the system 10 when it is used in a snowboard or downhill configuration. Splitboards are generally known to have a drawback of not being as torsionally stiff as standard boards. A tongue-and-groove connection through the middle portion of the board where the insert 24 is located may increase the torsional stiffness of the board overall. Torsional stiffness may be measured and calculated as the ratio between applied torque and the angle of deformation. For example, a ski-snowboard system 10 without a tongue-and-groove connection in the middle of the board between the insert and the skis may have a higher angle of deformation for the same force compared to the angle of deformation of a ski-snowboard system with a tongue-and-grove connection in the middle of the board with the insert.

Additionally, the tongue 70 of the insert 24 may be used to clean out the groove 62, 65 respectively, of first ski 15 and second ski 20. In use skinning uphill, these grooves can become filled with snow and/or ice. In other configurations, the insert 24 need not be provided with a tongue and similarly the side cuts 54, 58, respectively may not have grooves. Rather, the insert 24 may be held in place with one or more clips.

In other configurations, the insert need not be provided with tongues and may interface with the skis through one or more clips known in the art. Similarly, the inner edges of the skis need not be provided with corresponding grooves, but rather with mating clips or other connection means for connecting the insert to the skis in the downhill-snowboard configuration.

Various binding interfaces may be used in conjunction with the ski-snowboard system 10. FIG. 1 shows two exemplary configurations of binding interfaces installed on the first ski 15 and second ski 20 of the ski-snowboard system 10. Any suitable type of bindings that are removably connectable to the ski-snowboard system 10 may be used. For example, splitboard bindings such as those manufactured by Spark R&D, Karakoram, Union, K2, Nitro, etc., may be used. Similarly, any suitable type of binding interface may be used (generally speaking, users often choose binding interfaces that are made by the same manufacturer as the binding, but brands can also be mixed in some configurations). Splitboards generally include two sets of binding interfaces: one binding interface for the downhill mode 79 and another binding interface for the uphill mode 84. Common types of downhill mode binding interfaces include puck-style interfaces and non-puck-style interfaces. Puck-style interfaces include plastic or metal pucks that that mount to the splitboard. Typically, two pucks are provided (one on each side of the board) toward the tip 35 of the board, and two pucks are provided (one on each side of the board) toward the tail 38 of the board. For downhill riding, a user slides the first binding onto the first two pucks, and the second binding on the second two pucks. The bindings are then secured in place with a fastener, such as a clamp, pin, etc.

Common types of uphill mode binding interfaces include hinges or touring brackets provided proximal to the center of each of the first ski 15 and second ski 20. When a user desires to use the system 10 in an uphill mode, the bindings are placed onto the hinges or touring brackets of the skis and secured with a fastener such as a clamp, pin, etc.

Additionally, any known types of clips or fasteners may be used to connect the first ski 15 to the second ski 20, and likewise to the insert 24. In the configuration shown in FIG. 1, the clips 89 to connect the first ski 15 to the second ski 20 are placed at various intervals along the board. In some configurations, the clips may be attached at specific locations on each of the first ski 15 and second ski 20. In other configurations, the clips 89 may be provided at a plurality of locations. Clips such as a tip clip and tail clip are commonly known and used on split boards.

The ski-snowboard system 10 may be formed of any suitable type of material(s). In some configurations, fiberglass, plastic, steel, metals, and/or wood may be used to form the ski-snowboard system 10. Other available materials may be suitable for alternative embodiments of the ski-snowboard system 10. Those in the art will understand that in any suitable material, now known or hereafter developed, may be used in forming the ski-snowboard system 10. The ski-snowboard system 10 may also have any suitable dimensions as desired, and dimensions may vary based on both the desired performance of the ski-snowboard system 10 and the height/weight of the user. For example, the length of the ski-snowboard system may be from about 90 cm to about 180 cm, depending on the height and weight of the user. Similarly the width of the ski-snowboard system may vary based on the height and weight of the user.

In use, a user may first select a ski-snowboard system as disclosed herein. If the system is currently in the downhill or snowboard configuration, and the user desires to ski uphill, may first configure the snowboard-ski system into the uphill skinning configuration. The user may first take the bindings off the snowboard. Depending on the bindings and the bindings interface used, this typically involves the user releasing the toe lever and/or pulling a pin to remove the binding from the pucks. Next, the user may adjust the forward lean of the binding (typically it is desirable to remove any downhill forward lean when skinning uphill).

The user may then release the tip 35 clip and the tail 38 clip (and any other clips, if provided). Once the clips are released, the first ski 15 may be pulled away from the second ski 20, and the insert 24 removed. If needed, the tongue(s)

of the insert 24 may be used to clean out any snow and/or ice on the binding interfaces. The user may then place the insert 24 into a backpack (or otherwise stow the insert 24), and attach the bindings to the touring brackets, and attach their desired skins to the skis. The user need not switch the left and right sides of the boards, because the side cuts (inner edge side cut 54 on first ski 15 and inner edge side cut 58 on second ski 20) formed on the inner edges of each of the skis may assist the user in skinning uphill, and it may be desirable to have a cut-away with greater curvature on the inside edge of the ski when skinning uphill (or, when desired, the user may switch the left and right sides of the board).

When a user reaches the top of the hill and wishes to switch from the uphill/skinning configuration to the downhill/snowboarding configuration, the user may first remove the skins from the skis, take the bindings off the touring brackets, and adjust the bindings to give a forward lean for downhill, if desired. The user may then ensure that any snow/ice that has been packed around the tip and/or tail clips is removed (the tongues of the insert may be used to clear this away). Similarly, the tongues of the insert may be used to remove any snow/ice from the grooves of the inner edge side cuts. The user may then place the first ski 15 next to the second ski 20, with the inner edge of the first ski facing the inner edge of the second ski, and with the insert between the two skis in the void formed by the inner edge side cuts. The tongue of the insert 24 may be placed into the complementary grooves of the inner edge side cuts. The tip and the tail clips are then fastened, and the user slides the baseplate of their bindings into the pucks (or other non-puck binding interface) on the snowboard.

Aspect A: a ski-snowboard system for downhill snowboarding and uphill skinning, the system comprising: a first ski having an outer edge with a substantially concave outer edge side cut and an inner edge with a substantially concave inner edge side cut, the inner edge side cut having a greater degree of curvature than the outer edge side cut, at least a portion of the inner edge having a cutaway therein forming a first ski inner edge groove; a second ski having an outer edge with a substantially concave outer edge side cut and an inner edge with a substantially concave inner edge side cut, the inner edge side cut having a greater degree of curvature than the outer edge side cut, at least a portion of the inner edge having a cutaway therein forming a second ski inner edge groove; an insert having a substantially convex first edge with a first tongue extending from the first edge, the first tongue to engage the first ski inner edge groove, the insert having a substantially convex second edge with a second tongue extending from the second edge, the second tongue to engage the second ski inner edge groove; the system having a first uphill configuration in which the first ski and second ski are separated, and a second downhill configuration in which at least a portion of the inner edge of the first ski is attached to at least a portion of the inner edge of the second ski to form a snowboard and the insert is fitted between the first ski and the second ski, with the first tongue of the insert engaging the first ski inner edge groove and the second tongue engaging the second ski inner edge groove to increase a torsional stiffness of the second downhill configuration.

Aspect B: The ski-snowboard system of Aspect A, wherein the inner edge groove is formed in the inner edge side cut of the first ski and the second ski.

Aspect C: The ski-snowboard system of Aspect A or B, further comprising a fastening device comprising a first part and a second part, the first part mounted on the first ski and the second part mounted on the second ski, the fastening device being configured to reversibly affix the inside edge of the first ski to the inside edge of the second ski.

Aspect D: The ski-snowboard system of any of Aspects A through C, wherein the inner edge of the first ski comprises a substantially planar first portion towards a tip of the ski, a substantially planar second portion towards a tail of the ski, and wherein the substantially concave inner edge side cut comprises a middle portion of the inner edge of the first ski.

Aspect E: The ski-snowboard system of any of Aspects A through D, wherein the inner edge of the second ski comprises a substantially planar first portion towards a tip of the ski, a substantially planar second portion towards a tail of the ski, and wherein the substantially concave inner edge side cut comprises a middle portion of the inner edge of the second ski.

Aspect F: A ski-snowboard combination system for downhill snowboarding and uphill skinning, the system comprising: a first ski having an outer edge and an inner edge with a substantially concave shape, at least a portion of the inner edge forming a first ski inner edge groove; a second ski having an outer edge and an inner edge with a substantially concave shape, at least a portion of the inner edge forming a second ski inner edge groove; an insert having a substantially convex first edge and a substantially convex second edge; and the system having a first uphill configuration in which the first ski and second ski are separated, and a second downhill configuration in which at least a portion of the inner edge of the first ski is attached to at least a portion of the inner edge of the second ski to form a snowboard and the insert is fitted between the first ski and the second ski.

Aspect G: A ski-snowboard system comprising: a first ski having an outer edge and an inner edge with a substantially concave shape; a second ski having an outer edge and an inner edge with a substantially concave shape, an insert having a substantially convex first edge and a substantially convex second edge; and the system having a first uphill configuration and a second downhill configuration; wherein when the system is in the first uphill configuration, the first ski and second ski are separated, the first ski inner edge facing the second ski inner edge; and wherein when the system is in the second downhill configuration at least a portion of the inner edge of the first ski is attached to at least a portion of the inner edge of the second ski to form a snowboard and the insert is fitted between the first ski and the second ski.

Aspect H: The ski-snowboard system of aspect G, at least a portion of the inner edge of the first ski forming a first ski inner edge groove, and at least a portion of the inner edge forming a second ski inner edge groove.

Aspect I: The ski-snowboard system of aspect G or H, wherein the insert comprises a first tongue extending from the first edge, the first tongue to engage the first ski inner edge groove, and a second tongue extending from the second edge, the second tongue to engage the second ski inner edge groove.

Aspect J: The ski-snowboard system of aspect G, H, or I, wherein the outer edge of the first ski comprises a substantially concave outer edge side cut and the inner edge comprises a substantially concave inner edge side cut, the inner edge side cut having a greater degree of curvature than the outer edge side cut.

Aspect K: The ski-snowboard system of any of aspects G through J, wherein the outer edge of the second ski comprises a substantially concave outer edge side cut and the inner edge comprises a substantially concave inner edge side cut, the inner edge side cut having a greater degree of curvature than the outer edge side cut.

Aspect L: A ski-snowboard system comprising: a first ski (15) having an outer edge (26) with a substantially concave outer edge side cut (40) and an inner edge (47) with a substantially concave inner edge side cut (54), the inner edge side (54) cut having a greater degree of curvature than the outer edge side cut (40), at least a portion of the inner edge (54) having a first ski inner edge groove (62); a second ski (20) having an outer edge (30) with a substantially concave outer edge side cut (45) and an inner edge (50) with a substantially concave inner edge side cut (58), the inner edge side cut (58) having a greater degree of curvature than the outer edge side cut (45), at least a portion of the inner edge (50) having a second ski inner edge groove (65); an insert (24) having a substantially convex first edge (67) with a first tongue (70) extending from the first edge (67), the first tongue (70) to engage the first ski inner edge groove (62), the insert having a substantially convex second edge (72) with a second tongue (75) extending from the second edge (72), the second tongue (75) to engage the second ski inner edge groove (65); and the system having a first uphill configuration in which the first ski and second ski are separated, and a second downhill configuration in which at least a portion of the inner edge of the first ski is attached to at least a portion of the inner edge of the second ski to form a snowboard and the insert is fitted between the first ski and the second ski, with the first tongue of the insert engaging the first ski inner edge groove and the second tongue engaging the second ski inner edge groove to increase a torsional stiffness of the second downhill configuration.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

Although the foregoing disclosure provides many specifics, other applications are contemplated and these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

The invention claimed is:

1. A ski-snowboard system for downhill snowboarding and uphill skinning, the system comprising:

a first ski having an outer edge with a substantially concave outer edge side cut and an inner edge with a substantially concave inner edge side cut, the inner edge side cut having a greater degree of curvature than the outer edge side cut, at least a portion of the inner edge having a cutaway therein forming a first ski inner edge groove;

a second ski having an outer edge with a substantially concave outer edge side cut and an inner edge with a substantially concave inner edge side cut, the inner edge side cut having a greater degree of curvature than the outer edge side cut, at least a portion of the inner edge having a cutaway therein forming a second ski inner edge groove;

an insert having a substantially convex first edge with a first tongue extending from the first edge, the first tongue to engage the first ski inner edge groove, the insert having a substantially convex second edge with a second tongue extending from the second edge, the second tongue to engage the second ski inner edge groove; and the system having a first uphill configuration in which the first ski and second ski are separated, and a second downhill configuration in which at least a portion of the inner edge of the first ski is attached to at least a portion of the inner edge of the second ski to form a snowboard and the insert is fitted between the first ski and the second ski, with the first tongue of the insert engaging the first ski inner edge groove and the second tongue engaging the second ski inner edge groove to increase a torsional stiffness of the second downhill configuration.

2. The ski-snowboard system of claim 1, wherein the inner edge groove is formed in the inner edge side cut of the first ski and the second ski.

3. The ski-snowboard combination of claim 1, further comprising a fastening device comprising a first part and a second part, the first part mounted on the first ski and the second part mounted on the second ski, the fastening device being configured to reversibly affix the inside edge of the first ski to the inside edge of the second ski.

4. The ski-snowboard combination of claim 1, wherein the inner edge of the first ski comprises a substantially planar first portion towards a tip of the ski, a substantially planar second portion towards a tail of the ski, and wherein the substantially concave inner edge side cut comprises a middle portion of the inner edge of the first ski.

5. The ski-snowboard combination of claim 4, wherein the inner edge of the second ski comprises a substantially planar first portion towards a tip of the ski, a substantially planar second portion towards a tail of the ski, and wherein the substantially concave inner edge side cut comprises a middle portion of the inner edge of the second ski.

6. A ski-snowboard system comprising:

a first ski having an outer edge and an inner edge with a substantially concave shape;

a second ski having an outer edge and an inner edge with a substantially concave shape, an insert having a substantially convex first edge and a substantially convex second edge; and the system having a first configuration and a second configuration;

wherein when the system is in the first configuration, the first ski and second ski are separated, the first ski inner edge facing the second ski inner edge; and wherein when the system is in the second configuration, at least a portion of the inner edge of the first ski is attached to at least a portion of the inner edge of the second ski to form a snowboard and the insert is fitted between the first ski and the second ski.

7. The ski-snowboard system of claim 6, further comprising a first ski inner edge groove along the inner edge of the first ski, and a second ski inner edge groove along the inner edge of the second ski.

8. The ski-snowboard system of claim 7, wherein the insert comprises a first tongue extending from the first edge, the first tongue to engage the first ski inner edge groove, and a second tongue extending from the second edge, the second tongue to engage the second ski inner edge groove.

9. The ski-snowboard system of claim 8, wherein the outer edge of the first ski comprises a substantially concave outer edge side cut and the inner edge comprises a substantially concave inner edge side cut, the inner edge side cut having a greater degree of curvature than the outer edge side cut.

10. The ski-snowboard system of claim 6, wherein the outer edge of the second ski comprises a substantially concave outer edge side cut and the inner edge comprises a substantially concave inner edge side cut, the inner edge side cut having a greater degree of curvature than the outer edge side cut.

11. The ski-snowboard system of claim 9, wherein the first ski inner edge groove is formed in the substantially concave inner edge side cut of the first ski and wherein the second ski inner edge groove is formed in the substantially concave inner edge side cut of the second ski.

12. The ski-snowboard combination of claim 6, further comprising a fastening device comprising a first part and a second part, the first part mounted on the first ski and the second part mounted on the second ski, the fastening device being configured to reversibly affix the inside edge of the first ski to the inside edge of the second ski.

13. The ski-snowboard combination of claim 9, wherein the inner edge of the first ski comprises a substantially planar first portion towards a tip of the ski, a substantially planar second portion towards a tail of the ski, and wherein the substantially concave edge side cut comprises a middle portion of the inner edge of the first ski.

14. The ski-snowboard combination of claim 10, wherein the inner edge of the second ski comprises a substantially planar first portion towards a tip of the ski, a substantially planar second portion towards a tail of the ski, and wherein the substantially concave inner edge side cut comprises a middle portion of the inner edge of the second ski.

15. The ski-snowboard system of claim 6, wherein the outer edge of the first ski comprises a substantially concave outer edge side cut and the inner edge comprises a substantially concave inner edge side cut, the inner edge side cut having a greater degree of curvature than the outer edge side cut.

16. The ski-snowboard system of claim 6, wherein when the system is in the second configuration, a front portion of the inner edge of the first ski is attached to a front portion of the inner edge of the second ski.

17. The ski-snowboard system of claim 16, wherein a rear portion of the inner edge of the first ski is attached to a rear portion of the inner edge of the second ski.

18. The ski-snowboard system of claim 16, wherein when the system is in the second configuration, the front portion of the inner edge of the first ski abuts the front portion of the inner edge of the second ski.

19. The ski-snowboard system of claim 17, wherein the rear portion of the inner edge of the first ski abuts the rear portion of the inner edge of the second ski.

* * * * *